US009003942B2

(12) United States Patent
Nachshon et al.

(10) Patent No.: US 9,003,942 B2
(45) Date of Patent: Apr. 14, 2015

(54) ELECTROMAGNETIC BEAMS POWER COMBINING

(76) Inventors: Yehuda Nachshon, Haifa (IL); Dan Regelman, Haifa (IL)

( * ) Notice: Subject to any disclaimer, the term of this patent is extended or adjusted under 35 U.S.C. 154(b) by 42 days.

(21) Appl. No.: 13/141,335

(22) PCT Filed: Jan. 26, 2010

(86) PCT No.: PCT/IL2010/000060

§ 371 (c)(1),
(2), (4) Date: Jun. 22, 2011

(87) PCT Pub. No.: WO2010/073252

PCT Pub. Date: Jul. 1, 2010

(65) Prior Publication Data

US 2011/0253910 A1 Oct. 20, 2011

(51) Int. Cl.

| | |
|---|---|
| ***F41H 13/00*** | (2006.01) |
| ***F41G 5/08*** | (2006.01) |
| ***F41G 3/04*** | (2006.01) |
| ***F41G 3/14*** | (2006.01) |

(52) U.S. Cl.

CPC *F41G 3/04* (2013.01); *F41G 3/145* (2013.01); *F41G 5/08* (2013.01); *F41H 13/0043* (2013.01)

(58) Field of Classification Search

USPC ..... 89/1.11; 342/13; 250/203.2

See application file for complete search history.

(56) References Cited

U.S. PATENT DOCUMENTS

| | | | |
|---|---|---|---|
| 6,021,975 | A | 2/2000 | Livingston |
| 6,066,842 | A | 5/2000 | Livingston |
| 6,201,231 | B1 | 3/2001 | Regensburger |
| 6,265,704 | B1 | 7/2001 | Livingston |
| 6,795,174 | B1 | 9/2004 | Miller |
| 2007/0194977 | A1 | 8/2007 | Goutoule |
| 2009/0225299 | A1 | 9/2009 | Crawford |

*Primary Examiner* — Reginald Tillman, Jr.

(74) *Attorney, Agent, or Firm* — Mark David Torche; Patwrite LLC

(57) ABSTRACT

A method for combining power of separate directed energy beams each associated with a separate firing unit, on a common spot on target. The firing units are coordination and synchronization unit (FUSU) tracks a target and assigns a master firing unit and slave firing units. The master firing unit sends a guide beam to the target, forming a local coordinate system on said target, while the slave firing units track the target and track at least one spot of EM (electromagnetic) radiation on the target. The slave units calculate a direction vector, and fire a power beam at the target, together with the master unit.

7 Claims, 2 Drawing Sheets

ELECTROMAGNETIC BEAMS POWER COMBINING

FIELD OF THE INVENTION

The present invention relates to directed energy systems, in particular to means for increasing the delivered electromagnetic beam power on target by combination of plurality of radiation sources.

BACKGROUND OF THE INVENTION

In order for a EM (Electro-magnetic) beam intercepting a target to inflict an appreciable damage to the intercepted object, generally two conditions are to be met. One, the total power conveyed is to be high enough and two, the power is to be delivered to a location on the target which demonstrates such a vulnerability with respect to the incoming energy flux, such that the target becomes defunct or substantially damaged upon the interception.

In order to attain the required energy flux, a powerful enough EM radiation source should be used. Another approach is to use a plurality of weaker EM radiation sources, in which case the energy is to be delivered to the target on a common spot. This ability is usually limited by boresight errors of each radiation source. The disclosed invention addresses the method of overcoming this boresight error limitation.

SUMMARY OF THE INVENTION

In accordance with the present invention, a plurality of separate firing units (FUs) are coordinated and synchronized for firing at a common target to achieve a combination of power impinging on a common aim-point on a target. Each FU includes at least two EM beam generators, one of which is a guide beam generator and the other a power beam generator. The two beams are boresighted so that ideally their respective lines of sight (LOS) would coincide on a target. The FU might also include other boresighted beams such as laser used for illumination, rangefinder beam, boresight alignment beam, etc. The guide beam is typically a high beam quality, low divergence EM beam, producing a relatively small spot on the target surface. Alternatively, a beam with same or even larger dimension can be used. The power beam may be of lower beam quality meaning that the blob of illumination it produces on the target may be larger. A FU coordinator and synchronization unit assigns a specific FU the function of a master FU, for a specific target so that the spot of light produced by its guide beam on the target becomes a center of coordinates system referred to by the slave FUs. The guide beam may be deflected by a defined known angle from the main beam.

BRIEF DESCRIPTION OF THE DRAWINGS

The invention may be understood upon reading of the following detailed description of non-limiting exemplary embodiments thereof, with reference to the following drawings, in which.

The following detailed description of the invention refers to the accompanying drawings referred to above. Dimensions of components and features shown in the figures are chosen for convenience or clarity of presentation and are not necessarily shown to scale. Wherever possible, the same reference numbers will be used throughout the drawings and the following description to refer to the same and like parts.

DETAILED DESCRIPTION OF EMBODIMENTS OF THE INVENTION

Structure of the Firing Units (FUs)

Figure 1:
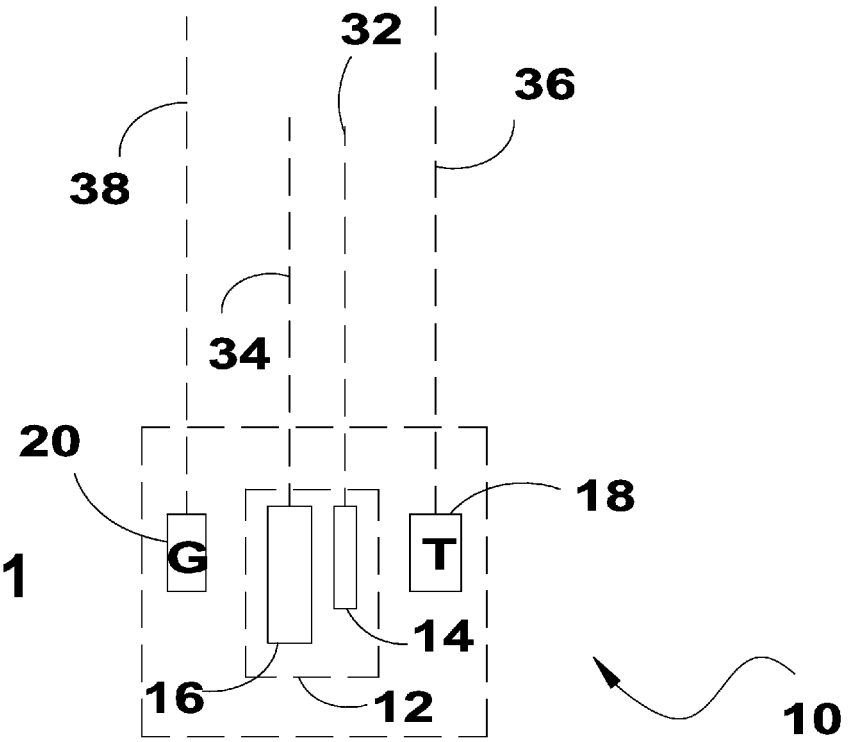
FIG. 1 is a highly schematic assembly scheme of a firing unit in accordance with the invention.

As can be seen in FIG. 1 to which reference is now made, a firing unit (FU) 10 in accordance with the present invention includes a directed energy subunit 12, in which two EM beam generators coexist. EM beam generator 14 is a guide beam generator (GBG) and EM beam generator 16 is a power beam generator (PBG), shown as the larger unit. A multiplicity of FUs are and synchronized by a FUs synchronization and coordination unit (FUSU), not shown. Each FU includes also two trackers, referred to also tracking subunits, a target tracker 18 and a guide beam tracker 20. Guide beam generator 14, power beam generator 16, target tracker 18 and guide beam tracker 20 are all boresighted, meaning practically that their respective line of sights (LOSs), 32, 34, 36 and 38, all coincide on a target.

In a typical system of the present invention, the beam of GBG is a low-divergence beam, while the beam produced by the PBG can be of lower beam quality (particularly with respect to the higher divergence), but of high power.

Exemplary Function of a FU

Once target tracker 18 acquires a target, it sends a confirmatory signal to a control unit (not specified). Following, the FU sends a power beam to the same place on the target surface as designated by the tracker. In parallel, a guide beam generator 14 sends a beam to the above said spot on the target surface. This beam is not necessarily of high power but is required to produce a spot of EM radiation on the target.

Coordinated and Synchronized Function of a Group of FU

Figure 2:
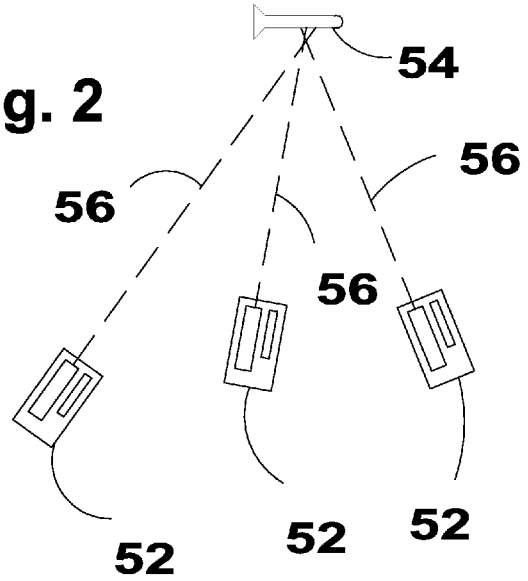
FIG. 2 is a scheme of deployed FUs respective of a target.

Referring to FIG. 2, several FUs 52 are shown pointing their power beams at a target 54, meaning that the LOS 56 of their respective power beam generators track with their aim point on the target surface.

Figure 3:
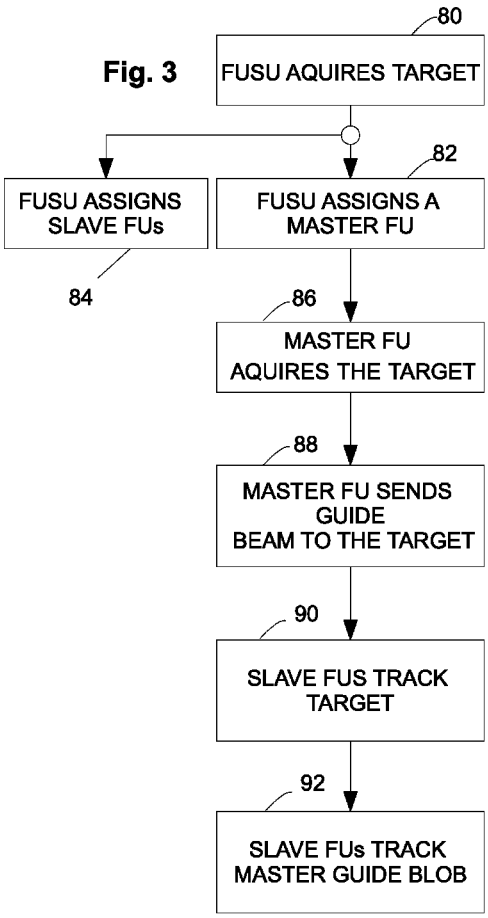
FIG. 3 is an event flow chart describing the sequence of events according to which a target is marked buy the master guide beam.

The process of intercepting a target and further inflicting damage to it is further explained with reference to the flow chart in FIG. 3. The FUSU, having a target tracker, which is typically a radar based apparatus or a thermal radiation tracker as disclosed in U.S. Pat. No. 6,476,859, acquires a target in step 80. Then, it assigns a master FU in step 82. An alternative is that the master FU is assigned regardless of target acquisition. Simultaneously the FUSU assigns slave FUs in step 84, an alternative to that is that all other FUs become slaves once a master has been assigned. The master FU acquires the target then at step 86 and further sends a guide beam to the target at step 88. The EM radiation spot created by the master guide beam can be considered as defining the center of a new local coordinate system. At step 90, the slave FUs track the target by using their respective target trackers, and at step 92 they each track the EM radiation spot on the target formed by the master guide beam, this spot is hereinafter referred to as master guide spot. Such tracking is performed using the dedicated guide beam tracker, typically using an optical sensing device for guide beam implemented by means of a laser beam.

Figure 4:
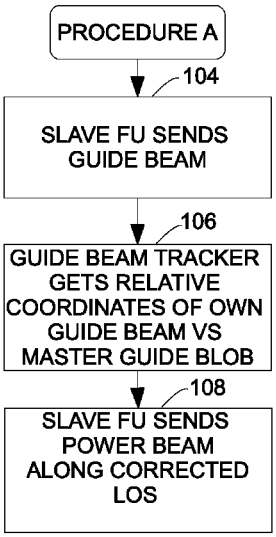
FIG. 4 is an event flow chart describing the sequence of events according to which a power beam is sent by slave FU in one option.
Figure 5:
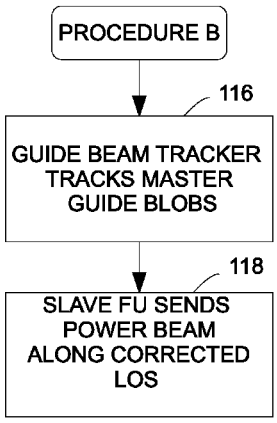
FIG. 5 is an event flow chart describing the sequence of events according to which a power beam is sent by slave FU in another option.

From this point onwards, there are two main possible continuation procedures according to which the task is implemented in accordance with the present invention. In procedure A, a preferred embodiment, described in FIG. 4, the slave FUs send each a guide beam all of which are referred to hereinafter as slave guide beams, at step 104, to the target, so the target may show at one point in time several blobs, one for each slave FU and one for the master FU. Guide beam tracker on each FU, recognizes its respective guide spot (see below) at step 106 and the distance between the master guide spot and its respective guide spot can be calculated. The guide beam tracker passing the information invokes the computing device to calculate the distance and direction between the spots. The resulting difference is translated into a direction, following which the power beam is sent to the target, in a corrected direction vector aiming at the center of the local coordinates system on the target, at step 108. In an alternative procedure, related to as procedure B in FIG. 5, the slave FUs do not use their guide beams, their respective guide beam trackers track the spot produced by the master guide beam on the target in step 116. Then, having calculated the correct direction vector to the master guide beam spot, at step 118 the slave FU sends its power beam in corrected LOS to the target.

Guide Beams Signature

The spot of light formed by the master guide beam has a specific signature, so that when tracked by the respective guide beam trackers of the slave FUs, they are able to differentiate this beam from the equivalent guide beams of the slave beams. Moreover all the respective spots formed by the respective guide beams on the target are to be differentiable from each other and from the master guide beam spot. In order to achieve this effect, each individual guide beam bears a specific signature. Such a signature is implemented in one or more beam features, for example specific distinct frequency, distinct amplitude modulation, or distinct frequency modulation of the pulses of the beam.

FU Assignment

In accordance with the present invention, for a given firing event, the FUSU may assign any available FU as a master or slave FU. In case that two or more targets are handled simultaneously, any given FU can function with regards to one target as a master and as slave with regards to a different target, concomitantly.

The invention claimed is:

1. A method for combining power of separate directed EM (electromagnetic) energy beams each associated with a separate firing unit, on a common spot on a target, said method comprising the steps of:

firing units coordination and synchronization unit (FUSU) tracking a target and assigning a master firing unit and at least one slave firing units;

said master firing unit sending a guide beam to said target, forming a spot and a local coordinate system on said target;

said at least one slave firing unit tracking said guide beam by using its respective guide beam tracker and calculating a direction vector to said spot of said guide beam of said master on said target; said at least one slave firing units tracking said target and sending to said local coordinate system formed by said guide beam of said master firing unit EM guide beam and sending at least one spot beam of EM radiation on said target;

said slave units and said master firing unit firing a power beam at said target thereby inflicting damage on said target and/or providing at least one illumination spot on the said above target.

2. A method as in claim 1 wherein said FUSU is assigning a master firing unit and slave firing units regardless of the said tracking of a target by said FUSU.

3. A method as in claim 1 wherein said slave units track spot of EM radiation associated with the master firing unit.

4. A method as in claim 1 wherein said slave units track spot of EM radiation associated with the master firing unit and other spots of EM radiation, and wherein calculating the direction vector to said target is based upon the relations between each respective EM spot and said spot of said master.

5. A method as in claim 1 wherein said guide beam of said master firing unit bears a unique signature.

6. A method as in claim 1 wherein said direction vector to said spot of said guide beam of said master firing unit is calculated by the respective guide beam trackers of said at least one slave firing unit, between the guide beams of said at least one slave unit and the spot of said guide beam of said master firing unit.

7. A method as in claim 1, wherein said direction vector for said at least one slave firing unit is calculated by said respective guide beam tracker of said slave firing units relative to said guide beam spot of said master firing unit on said target.

* * * * *